US006220900B1

(12) United States Patent
Huang

(10) Patent No.: US 6,220,900 B1
(45) Date of Patent: Apr. 24, 2001

(54) LOW PROFILE ELECTRICAL CONNECTOR ASSEMBLY WITH LOW INSERTION FORCE

(75) Inventor: Wayne Huang, Alhambra, CA (US)

(73) Assignee: Hon Hai Precision Ind. Co., Ltd., Taiepi Hsien (TW)

( * ) Notice: Subject to any disclaimer, the term of this patent is extended or adjusted under 35 U.S.C. 154(b) by 0 days.

(21) Appl. No.: 09/442,079

(22) Filed: Nov. 16, 1999

Related U.S. Application Data

(63) Continuation-in-part of application No. 09/427,828, filed on Oct. 27, 1999.

(51) Int. Cl.[7] ..... H01R 24/06
(52) U.S. Cl. ..... 439/676; 439/374
(58) Field of Search ..... 439/676, 701, 439/374, 376

(56) References Cited

U.S. PATENT DOCUMENTS 5,531,612 * 7/1996 Goodall et al. ..... 439/676
5,779,503 * 7/1998 Tremblay et al. ..... 439/676
5,957,730 * 9/1999 Wang ..... 439/676
6,012,953 * 1/2000 Francis ..... 439/676

* cited by examiner

*Primary Examiner*—Gary F. Paumen
(74) *Attorney, Agent, or Firm*—Wei Te Chung

(57) ABSTRACT

A lower profile electrical connector assembly for electrical connection with a mating plug connector includes a conductive shell, an insulative housing, and a contact spacer molded with a plurality of contacts. The housing of the electrical connector assembly is equipped with the contact spacer thereby pre-loading the contacts for lowering the insertion force of a mating connector acted on the contacts. Also, a slant formed inside the receiving spacer of the housing is capable to angularly bias the insertion of the mating electrical connector into the housing on stages to avoid the direct impact of the mating connector on the contacts for lowering the insertion force more.

1 Claim, 13 Drawing Sheets

LOW PROFILE ELECTRICAL CONNECTOR ASSEMBLY WITH LOW INSERTION FORCE (This application is a continuation in part of U.S. patent application entitled "ULTRA LOW PROFILE ELECTRICAL CONNECTOR ASSEMBLY" with a Ser. No. 09/427,828, filed on Oct. 27, 1999)

BACKGROUND OF THE INVENTION

1. Field of the Invention

The present invention relates to an electrical connector assembly, and more particularly to an ultra low profile electrical connector assembly for mating with an external electrical connector.

2. Description of the Prior Art U.S. Pat. Nos. 4,497,526, 4,647,136, 4,703,991, 4,786,259, 4,878,848, 4,878,858, 4,915,655, 5,035,641, 5,118,312, 5,378,172 and 5,702,271 indicate a prior low profile RJ connectors which extends beyond a notch of a circuit board in a half-height thereof, or/and is diminished in the thickness of a wall of a plastic housing to form a cutout where a latch of a mating plug extends through. However, the lowered-profiles of these connectors are insufficient in applying with a thinner electrical device like a PCMCIA card for computer.

U.S. Pat. Nos. 5,183,404, 5,336,099, 5,338,210, 5,411,405 and 5,547,401 disclose another type low profile RJ connector perpendicularly attached into the PCMCIA card. However, the vertical insertion of the RJ plug inside the RJ connector causes a protruded outgrowth of the entire assembled PCMCIA card.

U.S. Pat. Nos. 5,248,267, 5,562,504, 5,660,568, 5,773,332 and 5,938,480 disclose another low profile RJ connector which horizontally receives a mating RJ plug therein. The lowered profile of the RJ connector is still insufficient and lacks an EMI protection.

U.S. patent application Ser. No. 09/404,441 filed on Sep. 22, 1999 by the same inventor and assignee as the instant application, discloses that an upper and lower metallic shells are integrally molded with an upper and lower plastic covers of a connector wherein at least a portion of one of the upper and lower shells protruding over the corresponding cover. U.S. patent application entitled "ULTRA LOW PROFILE ELECTRICAL CONNECTOR ASSEMBLY" with a Ser. No. 09/427,828 filed on Oct. 27, 1999, is a continuation-in-part of the U.S. patent application Ser. No. 09/404,441, which adopts the similar principle to lower the profile/height of an entire connector like a RJ series connector. The instant application is a co-pending application with the U.S. patent application entitled "ULTRA LOW PROFILE ELECTRICAL CONNECTOR ASSEMBLY".

SUMMARY OF THE INVENTION

An objective of this invention is to provide a low profile electrical connector assembly with a plurality of pre-loaded contacts thereby lowering the insertion force of a mating connector acted on the contacts of the connector assembly.

Another objective of this invention is to provide the low profile electrical connector assembly with a slant formed inside an insulative housing to angularly bias the insertion of the mating electrical connector into the housing on stages thereby avoiding the direct impact of the mating connector on the contacts of the connector assembly.

In order to achieve the object set forth, a lower profile electrical connector assembly in accordance a preferred embodiment of the present invention for electrical connection with an mating plug connector includes a conductive shell, an insulative housing and a plurality of contacts fixedly received inside a contact spacer. The shell is made of a metal sheet to include a planar portion and two opposed and spaced extensions. The housing is integrally and directly molded to the shell wherein the extensions of the shell are respectively enclosed inside several vertical walls formed with the housing, and a horizontal wall integrally formed perpendicular to the vertical walls is spaced opposite to the planar portion of the shell. A receiving space is defined with the vertical and horizontal walls of the housing. A holder section located on each vertical wall of the housing far away the horizontal wall. Therefore, the profile of the entire connector assembly is reduced more than those of the prior arts.

The electrical connector assembly is equipped with the contact spacer thereby pre-loading the contacts thereby lowering the insertion force of a mating connector acted on the contacts. Also, a slant formed inside the receiving spacer of the housing is capable to angularly bias the insertion of the mating electrical connector into the housing on stages to avoid the direct impact of the mating connector on the contacts for lowering the insertion force more.

These and additional objects, features, and advantages of the present invention will become apparent after reading the following detailed description of the preferred embodiments of the invention taken in conjunction with the appended drawings.

DETAILED DESCRIPTION OF PREFERRED EMBODIMENT

Detailed reference will now be made to a preferred embodiment of the present invention.

Figure 1:
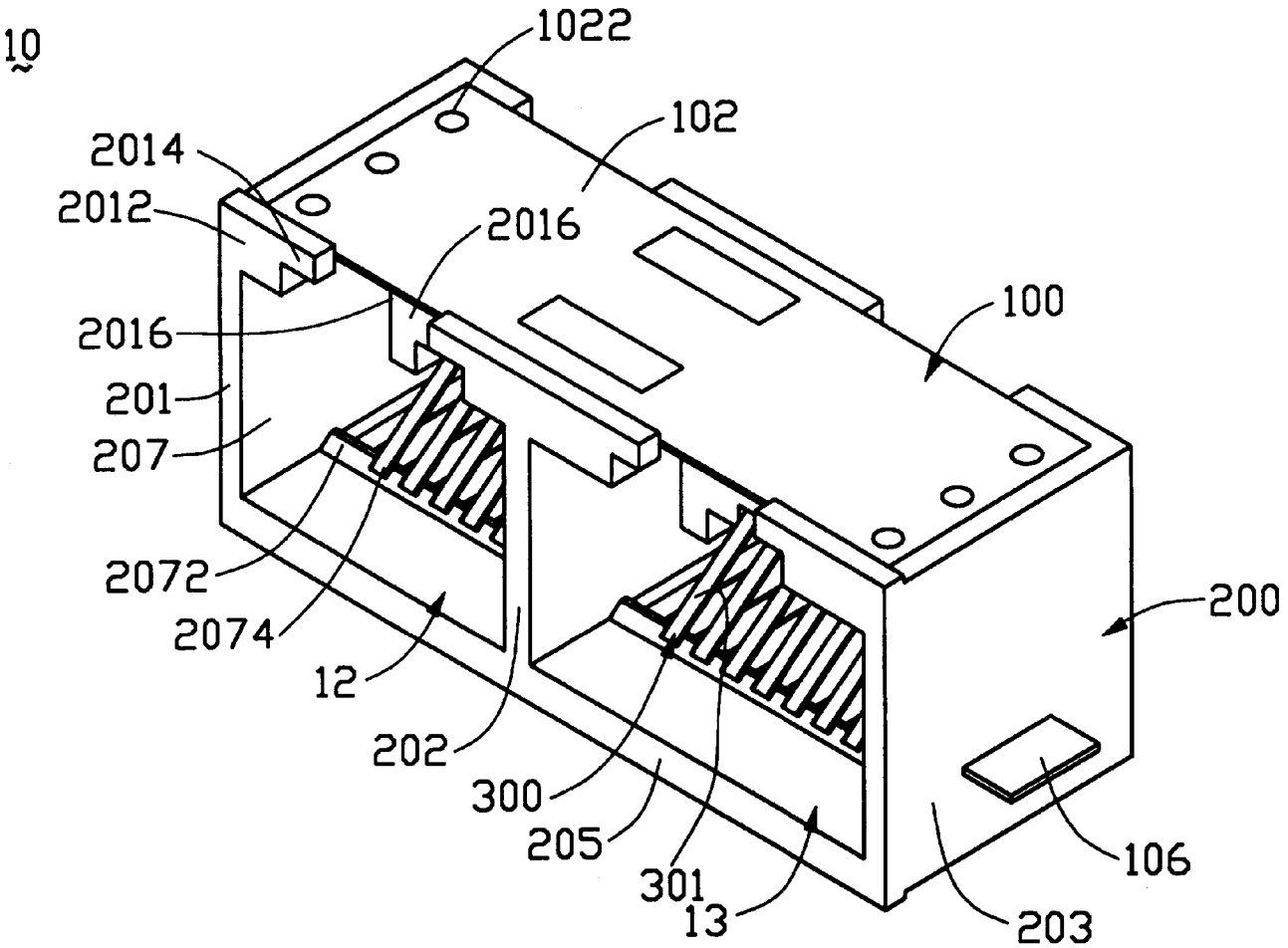
FIG. 1 is a front perspective view of a low profile electrical connector assembly in accordance with the present invention.

Referring to a preferred embodiment in accordance with the present invention shown in FIG. 1, a low profile electrical connector assembly 10 consists of two different type connectors 12, 13 like a RJ11 and RJ45 connectors for respective electrical connection of a mating plug connector 50 having a latch 52 thereof and contacts 54 therein (See FIG. 7) with a circuit board 20 (See FIG. 8) having plenty of conductive traces 21 formed on at least one of opposed surfaces thereof. The electrical connector assembly 10 further includes a conductive shell 100, an insulative housing 200 and a plurality of contacts 300.

Figure 13:
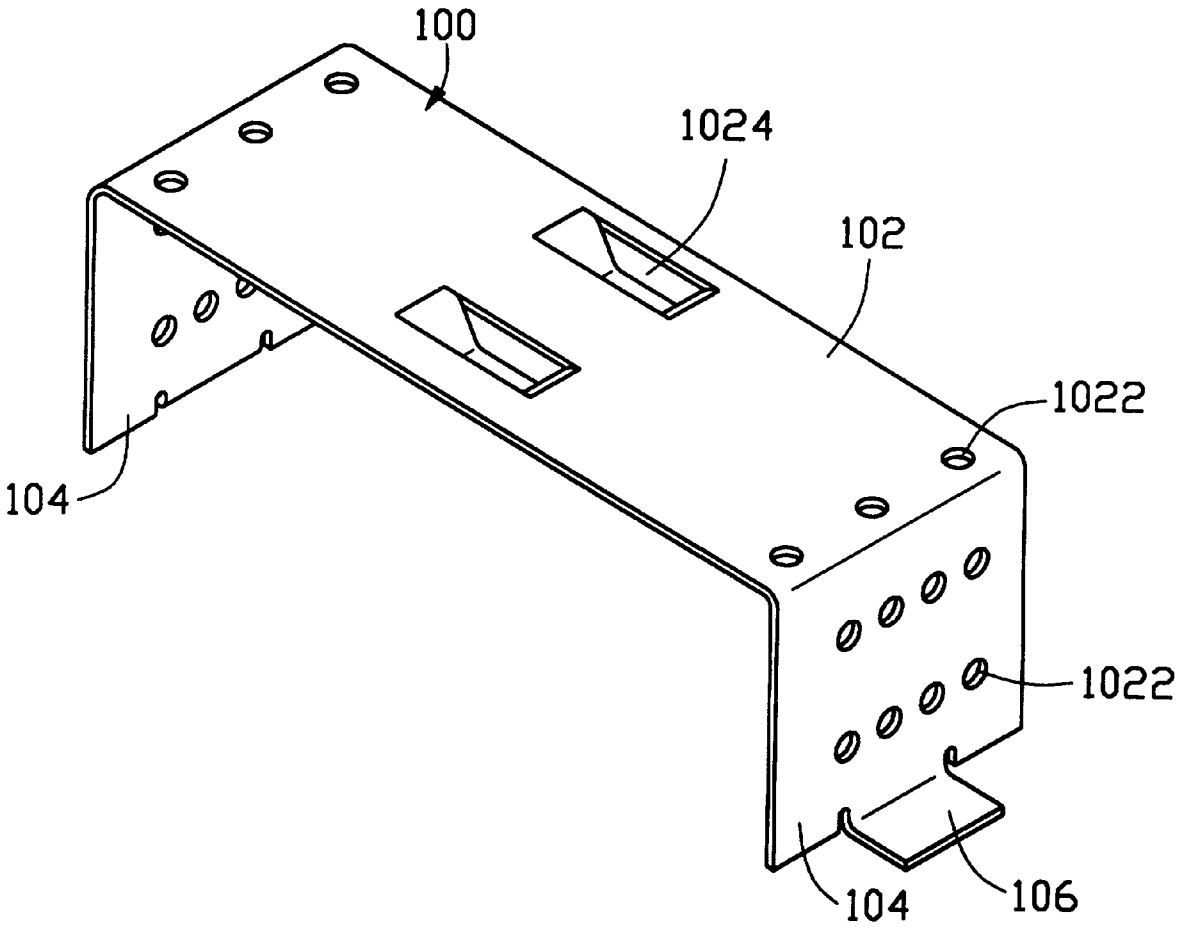
FIG. 13 is a perspective view of a shell used in the electrical connector assembly of FIG. 1.

As shown in FIG. 13, the conductive shell 100 made of a thin metal sheet for electrically shielding the insulative housing 200, integrally forms a planar portion 102, and two opposed and spaced extensions 104 integrally connected with opposed edges of the planar portion 102 and vertically extending outward. A tab 106 horizontally and outwardly extends from an edge of each of the extensions 104 for mounting the connector assembly 10 on the circuit board. A plurality of through hole 1022 and caves 1024 are defined around the conductive shell 100 thereby permitting the influx of a few molding materials shaping the housing 200 by an insert-molding process for the combination of the shell 100 with the housing 200 as the result shown in FIG. 1. The other detail with respect to the insert-molding process between the housing 200 and the shell 100 has been described in U.S. patent application entitled "ULTRA LOW PROFILE ELECTRICAL CONNECTOR ASSEMBLY", and thus is not repeated herein.

Figure 4:
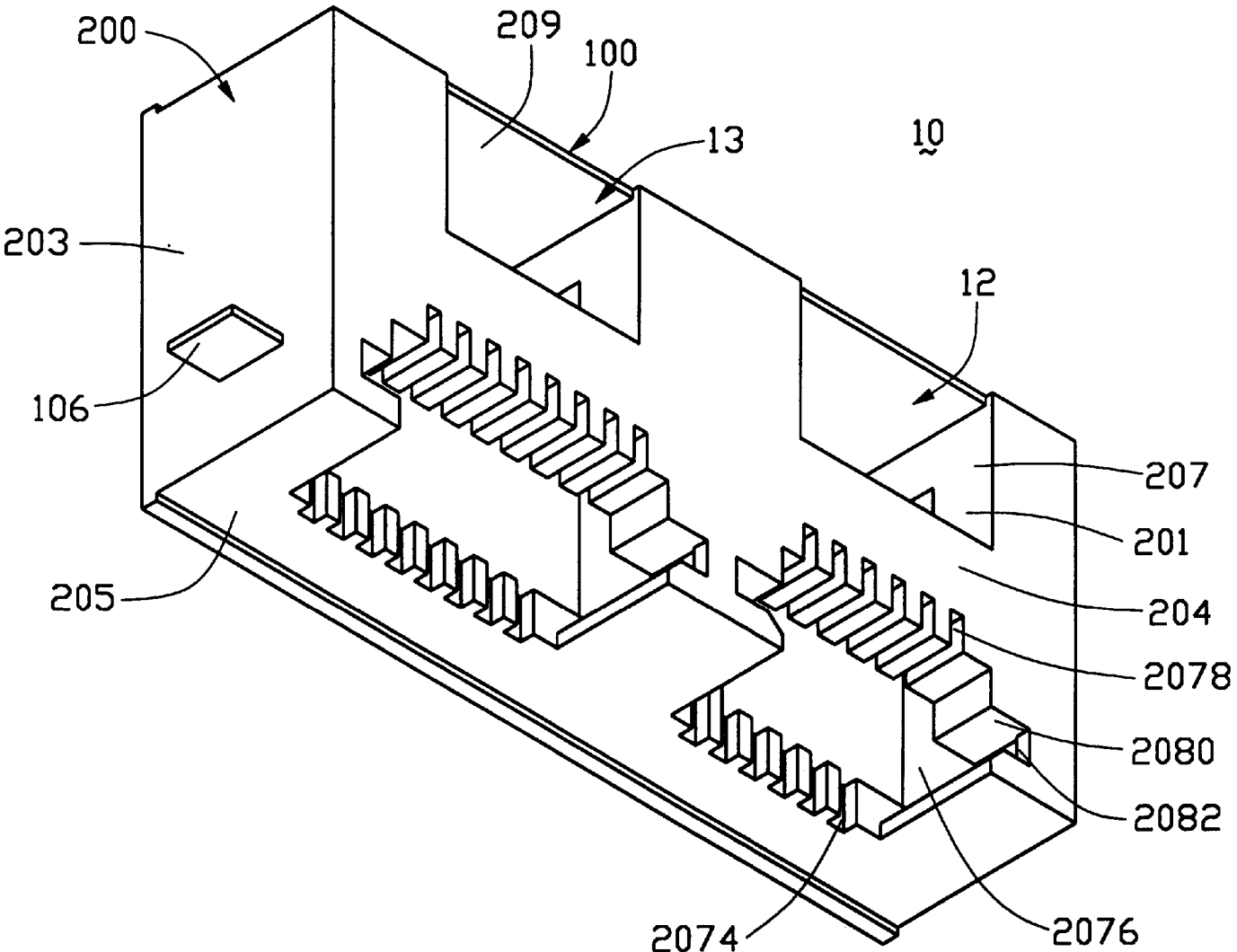
FIG. 4 is a rear perspective view of an insulative housing used in the electrical connector assembly of FIG. 1.
Figure 8:
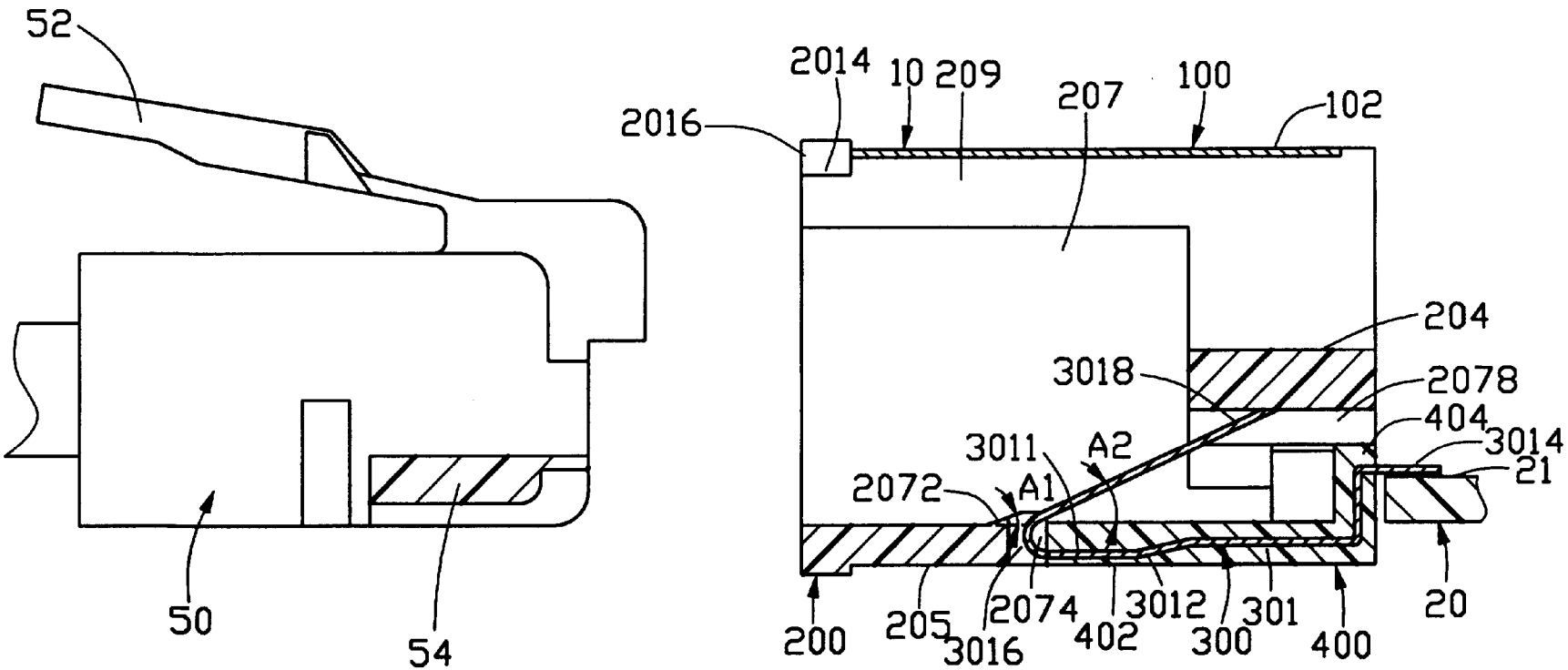
FIGS. 8–12 are cross-sectional views of the electrical connector assembly of FIG. 1 showing the successive steps of inserting the mating connector into the connector assembly.
Figure 12:
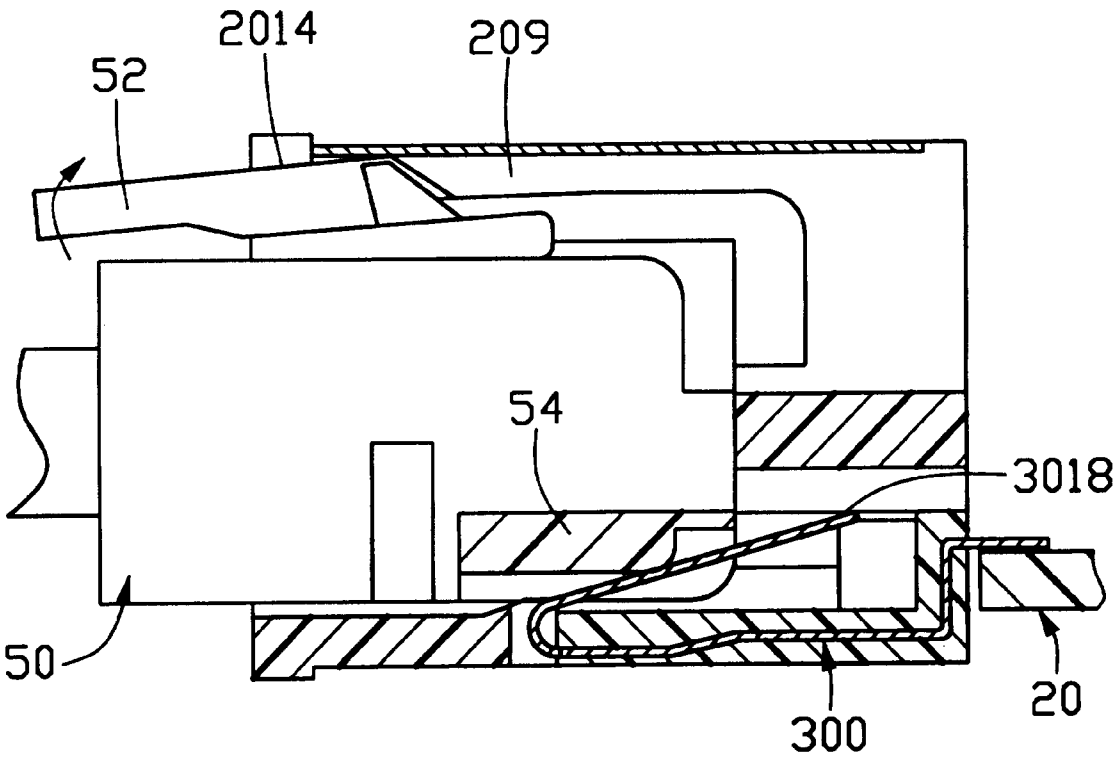

The molded housing 200 as shown in FIGS. 1, 4 & 8 integrally forms a horizontal wall 205 defined with an innermost surface and an outermost surface opposite to the innermost surface. A plurality of lateral vertical walls 201–203 and a rear vertical wall 204 positioned normally of the horizontal wall 205. A receiving space 207 for receiving the mating plug connector 50 therein is defined among each two of the opposite vertical walls 201–203 and the horizontal wall 205 of the housing 200. A platform portion 2012 is laterally and horizontally formed with a remote end of each of the vertical walls 201–203 wherein the platform portions 2012 of each two of the opposed vertical walls 201–203 are fully separated apart from each other by a slot 209. Further, a holder section 2014 laterally and horizontally extends from each platform portion 2012 of the vertical walls 201–203 to enter the slot 209 for locking with the latch 52 of the mating plug connector 50. A cutout 2016 thinner than the slot 209 is defined between the two adjacent holder sections 2014, where the latch 52 of the mating plug connector 50 passes through the shell 100 after being inserted into the receiving space 207 of the housing 200 as shown in FIG. 12.

A notch 2076 as shown in FIG. 4 for each of the connectors 12, 13 is defined on an jointing region of the horizontal wall 205 with the rear vertical wall 204, and is mutually communicated with the receiving space 207. A plurality of first recesses 2078 are downward defined on the vertical wall 204 at a position next to each notch 2076. A pair of grooves 2080 are respectively and oppositely defined on each two of the opposite vertical walls 201–203 wherein a bar 2082 forms adjacent to an entrance of each groove 2080. A slant 2072 as shown in FIGS. 1 & 8 in relation to each notch 2076 is transversely formed on the innermost surface of the horizontal wall 205 of the housing 200 and protrudes toward the receiving space 209 at a first angle A1 with regard to the horizontal wall 205. A plurality of outlets 2074 are defined through each slant 2072 of the horizontal wall 205 in alignment with the first recesses 2074 of the vertical wall 204. Optionally, the housing 200 can be disposed in front of an edge of the circuit board 20 so that only less than a total height of the housing is located over one of opposed surfaces of the circuit board 20 as shown in FIG. 8.

Figure 2:
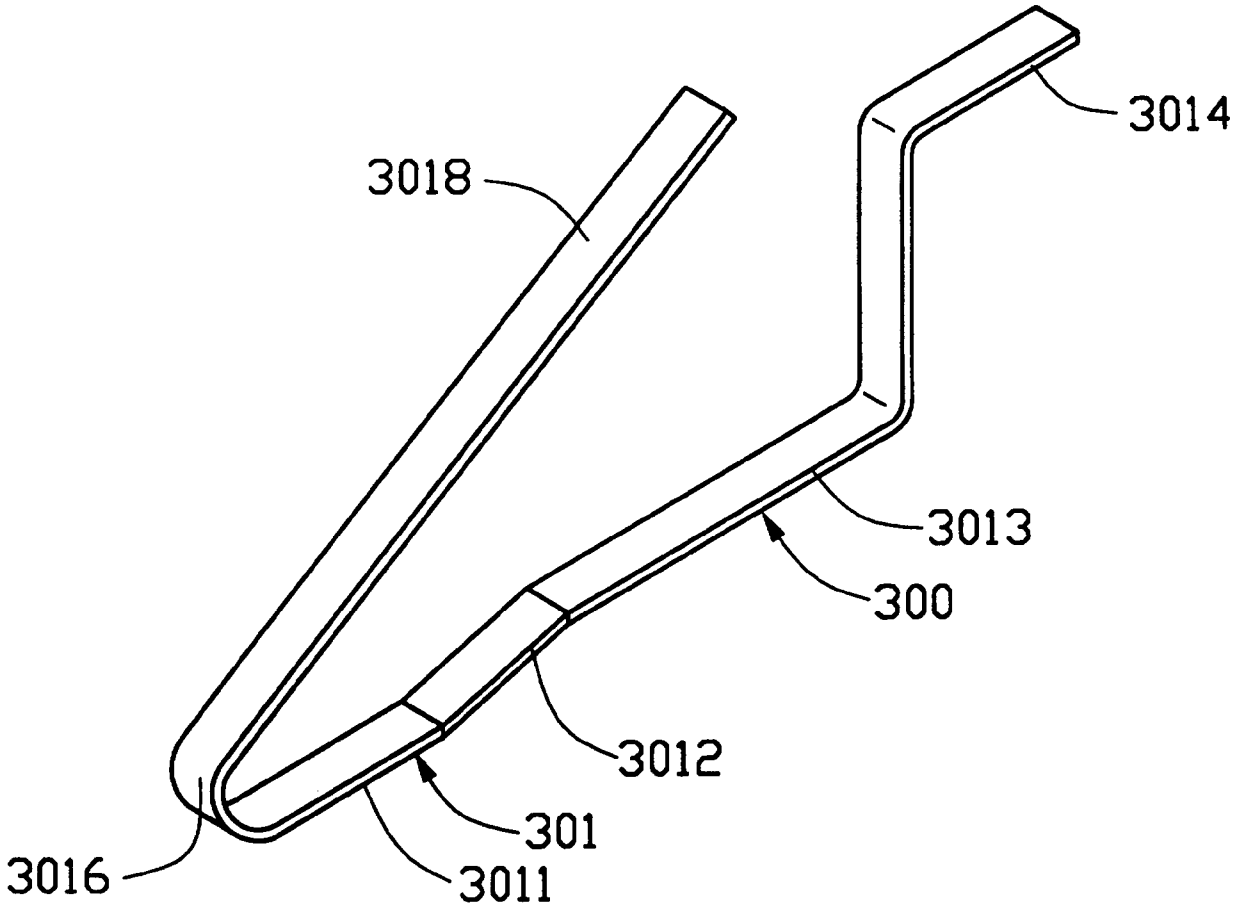
FIG. 2 is a perspective view of one of plenty of contacts used in the electrical connector assembly shown in FIG. 1.

The contacts 300 as shown in FIG. 2 are fabricated from a conductive metal. Each of the contacts 300 forms a base section 301 divided into a front base section 3011 and a rear base section 3012 by an offset 3012 therebetween. A bight section 3016 is reversedly and angularly extended from the front base section 3011. An engaging section 3018 is outwardly extended from the bight section 3016 for electrical engagement with the mating plug connector 50. A tail section 3014 with a distal end is integrally connected with the rear base section 3013. The offset 3012 is designated to constitute the difference in levels between the front and rear base sections 3011, 3013. Therefore, the front base section 3011 is angulated with regard to the corresponding engaging section 3018 via the bight section 3016 to provide the engaging section 3018 with sufficient elasticity as soon as depressingly contacting with the mating connector 50.

Figure 3:
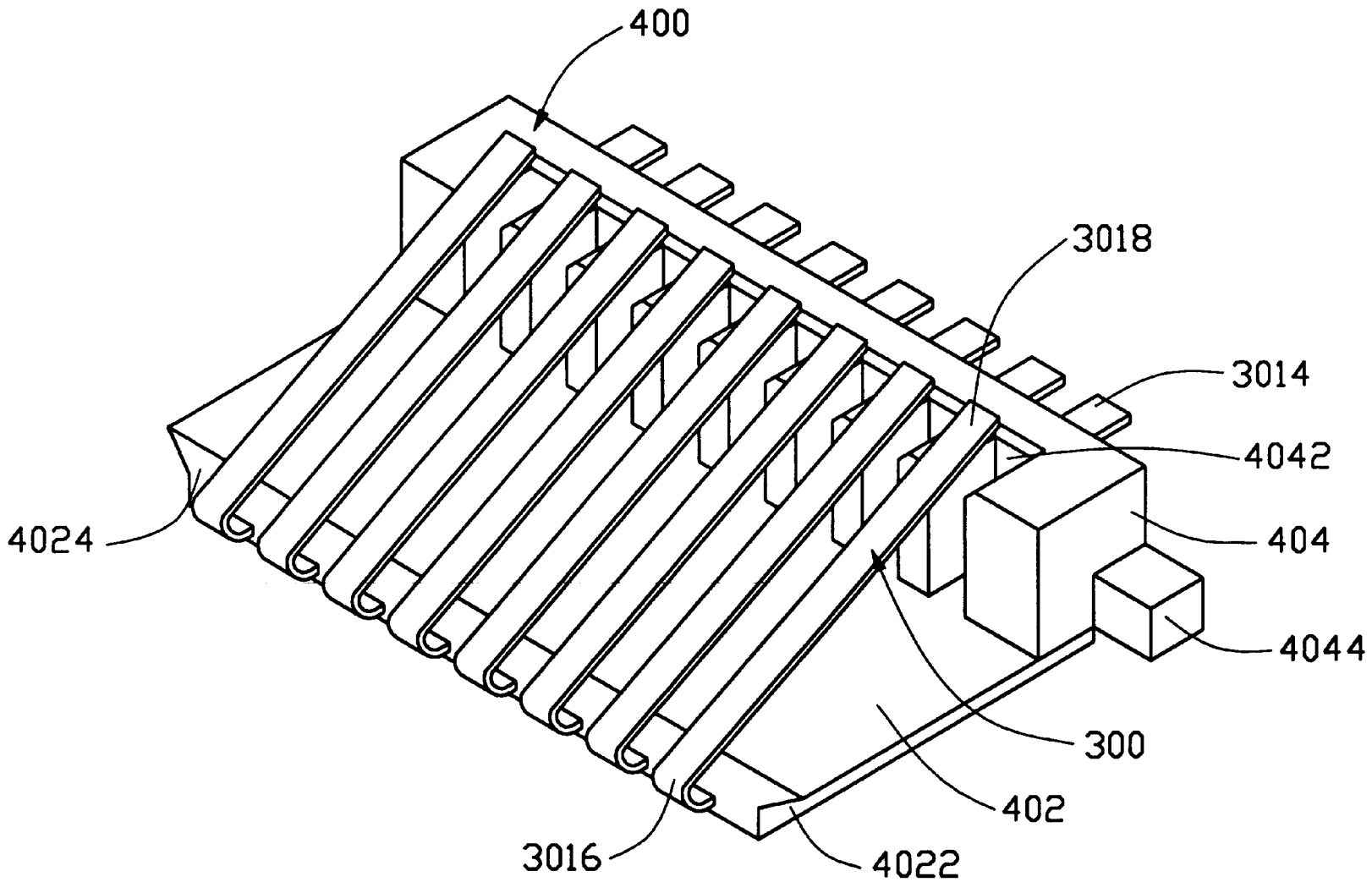
FIG. 3 a perspective view of a contact spacer molded with the contacts of FIG. 2.

Referring to FIGS. 3 & 8, an insulative contact spacer 400 is molded with the contacts 300 of each of the connectors 12, 13. Meanwhile, (the base sections 301 of the contacts 300 are fully enclosed inside a horizontal portion 402 of the contact spacer 400.) The front base section 3011 of each of the contacts 300 is biased toward an outermost surface of the horizontal portion of 402 of the contact spacer 400. The tail sections 3014 of the contacts 300 perpendicularly extend out of a vertical portion 404 of the contact spacer 400 to reach the corresponding conductive trance 21 of the circuit board 20 as shown in FIG. 8. A plurality of third recesses 4042 are defined on a vertical portion 404 of each contact spacer 400 in alignment with the first recesses 2078 of the housing for reception of the distal ends of the deflected engaging sections 3018 of the contacts 300. A pair of ears 4044 are formed on opposite sides of the vertical portion 404. A pair of lateral wedges 4022 are respectively formed at opposite sides of the contact spacer 402 at a position aligned with the corresponding ear 4044.

In the process of molding the contact spacer 400 with the corresponding contact 300 as shown in FIG. 8, the bight sections 3016 of the contacts 300 are exposed out of a front wedge 4024 formed on the contact spacer 400. The offset 3012 of each of the contacts 300 can efficiently secure the entire base section 301 inside the horizontal portion 402 of the contact spacer 400 and simultaneously form a second angle A2 of the engaging section 3018 of each of the contacts 300 with regard to the horizontal portion 402, which provides the contacts 300 with sufficient resiliency.

Figure 5:
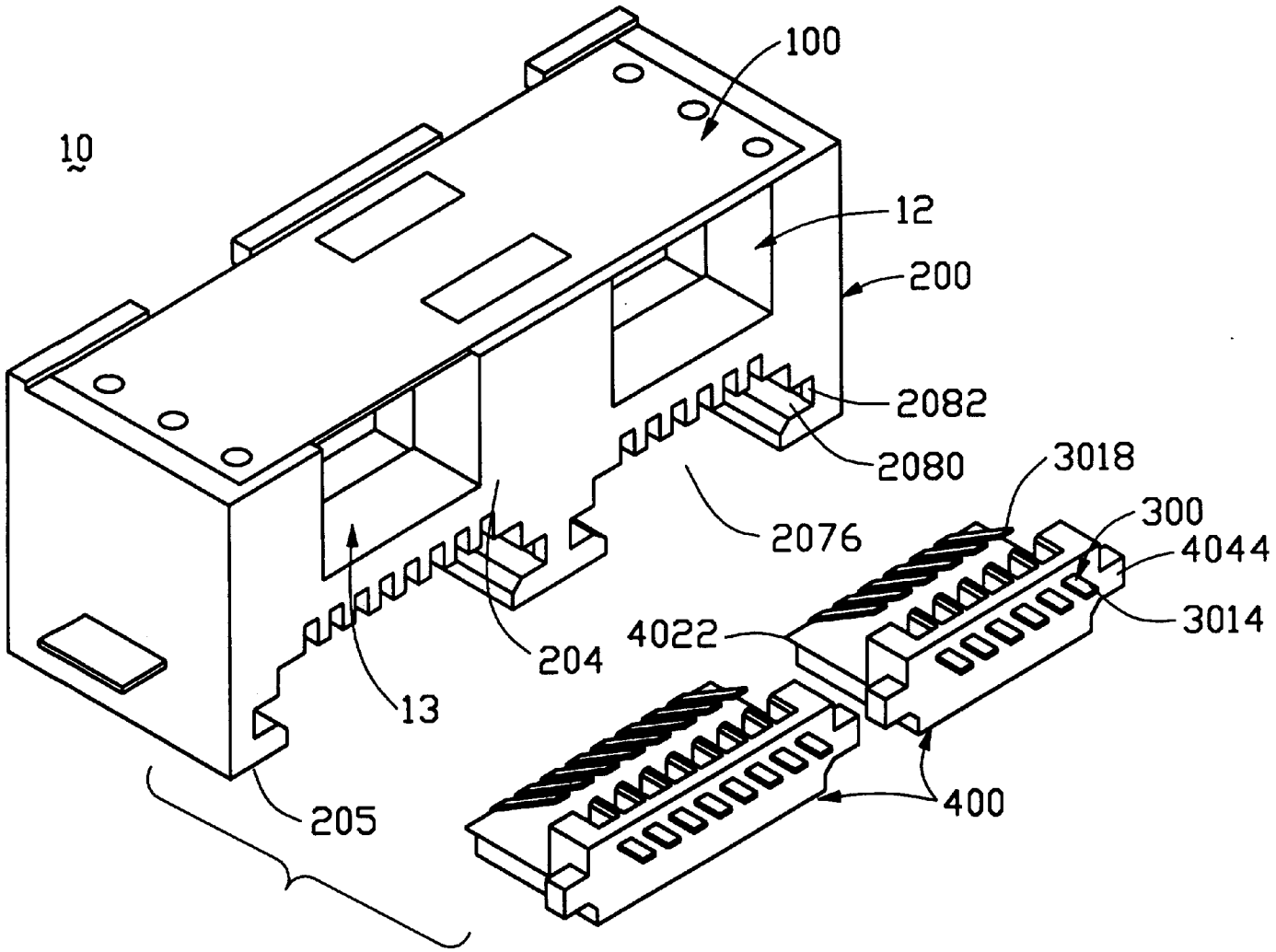
FIG. 5 is an exploded view of the electrical connector assembly of FIG. 1 showing the housing and the contact spacers.
Figure 6:
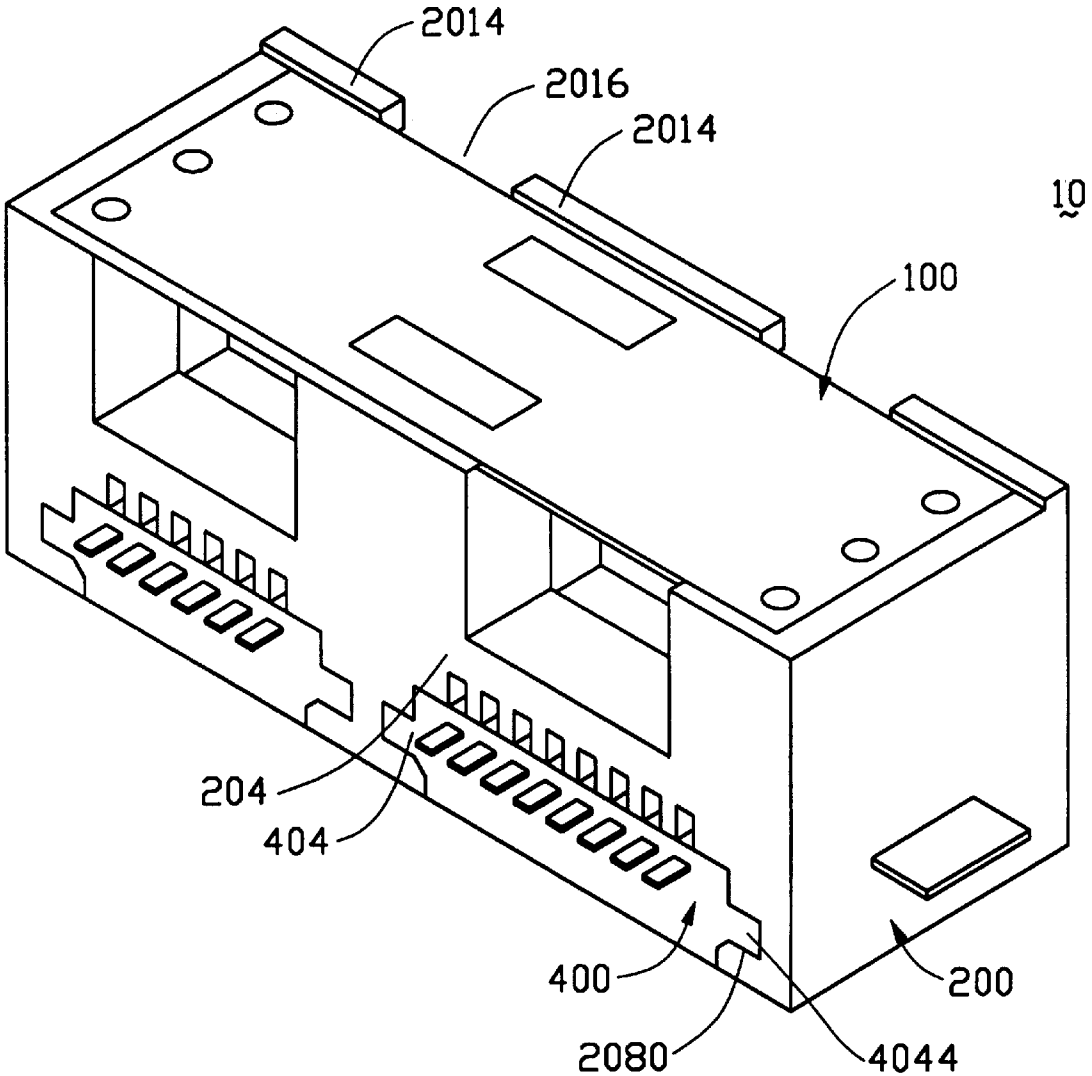
FIG. 6. is a rear perspective view of the electrical connector assembly showing the assembly of the housing and the contact spacers of FIG. 5.

In assembling each contact spacer 400 within the corresponding notches 2076 of the housing 200 as illustrated in FIG. 5, the wedges 4022 and the ears 4044 of each of contact spacers 400 slide within the grooves 2080 of the housing 200. Then, the ears 4044 are snapped with the bars 2082 next to an entrance of each groove 2080 as shown in FIG. 6. Thus, the vertical portion 404 of the contact spacer 400 is aligned with the vertical wall 204 of the housing 200, and the horizontal portion 402 of the contact spacer 400 is aligned and coplanar with the horizontal wall 205 of the housing 200. Also, the bight section 3016 of each of the contacts 300 exposed outside the contact spacer 400 is received within the corresponding outlet 2074 of the horizontal wall 205 of the housing 200 to permit that the engaging section 3018 of the contact 300 extends toward the receiving space 207 of the housing 200. Meanwhile, the distal ends of the engaging sections 3018 of the contacts 300 extends through the receiving space 207 and the first recesses 2078 of the housing 200, and are therefore resiliently deflected by the rear vertical wall 204 of the housing 200. The deflection of the engaging sections 3018 toward the horizontal wall 205 of the housing 200 are capable to reduce the insertion force of the mating plug connector 50 acted on the engaging sections 3018 of the contacts 300 as pre-loaded. The result is shown in FIG. 8.

It is noted in FIG. 8 that the first angle A1 of the slant 2072 on the horizontal portion 205 of the housing 200 is designated to be substantially identical with or more than the second angle A2 of the engaging section 3018 of the corresponding contact300. Optionally, an jointing point of the engaging section 3018 with the bight section 301 of each of the contacts 300 either overlaps with the innermost surface of the horizontal wall 205 of the housing 200, or located between the innermost and outermost surfaces of the horizontal wall 205 of the housing 200.

Figure 9:
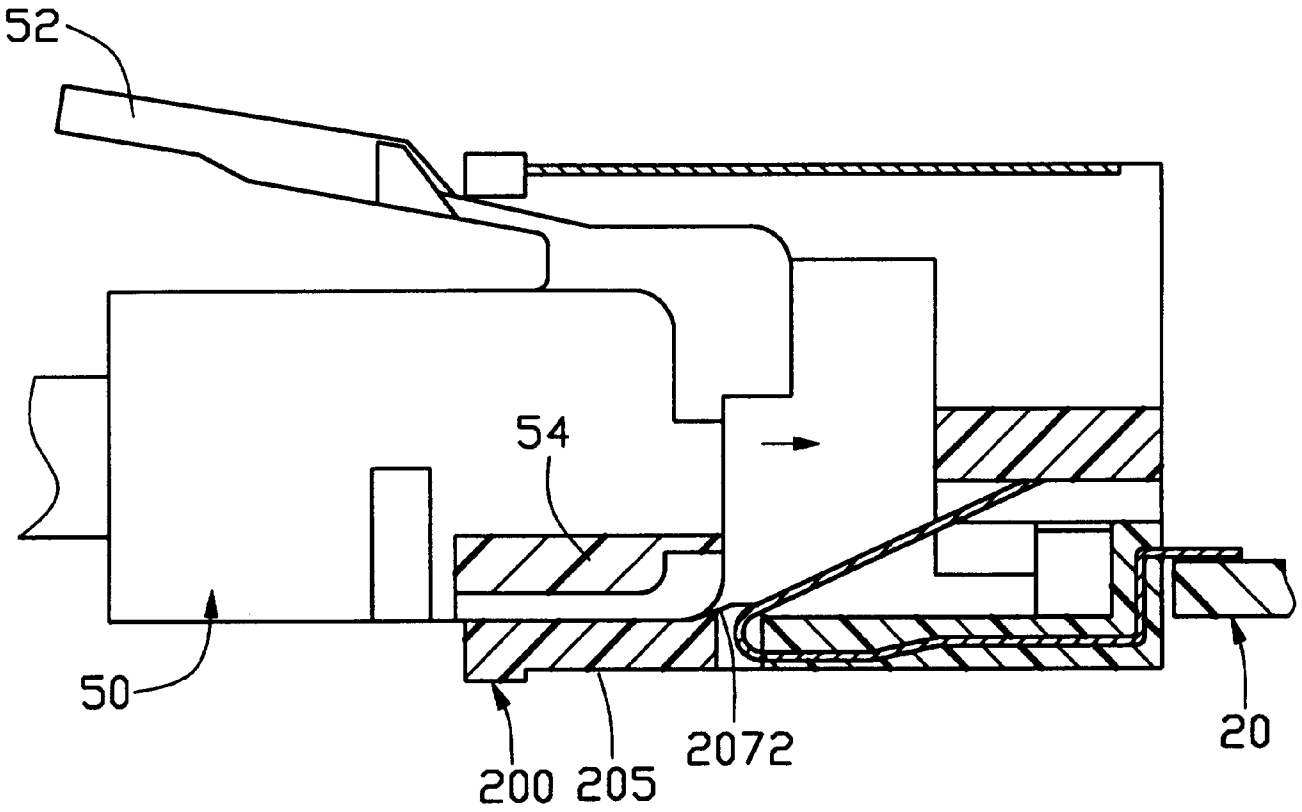

Several successive steps of inserting a mating plug connector 50 having a latch 52 into one of the corresponding electrical connectors 12, 13 are illustrated in FIGS. 8–12. In the first step as shown in FIG. 9, the mating plug connector 50 is horizontally moved to reach a first position in front of the slant 2072 of the horizontal wall 205 of the housing.

Figure 10:
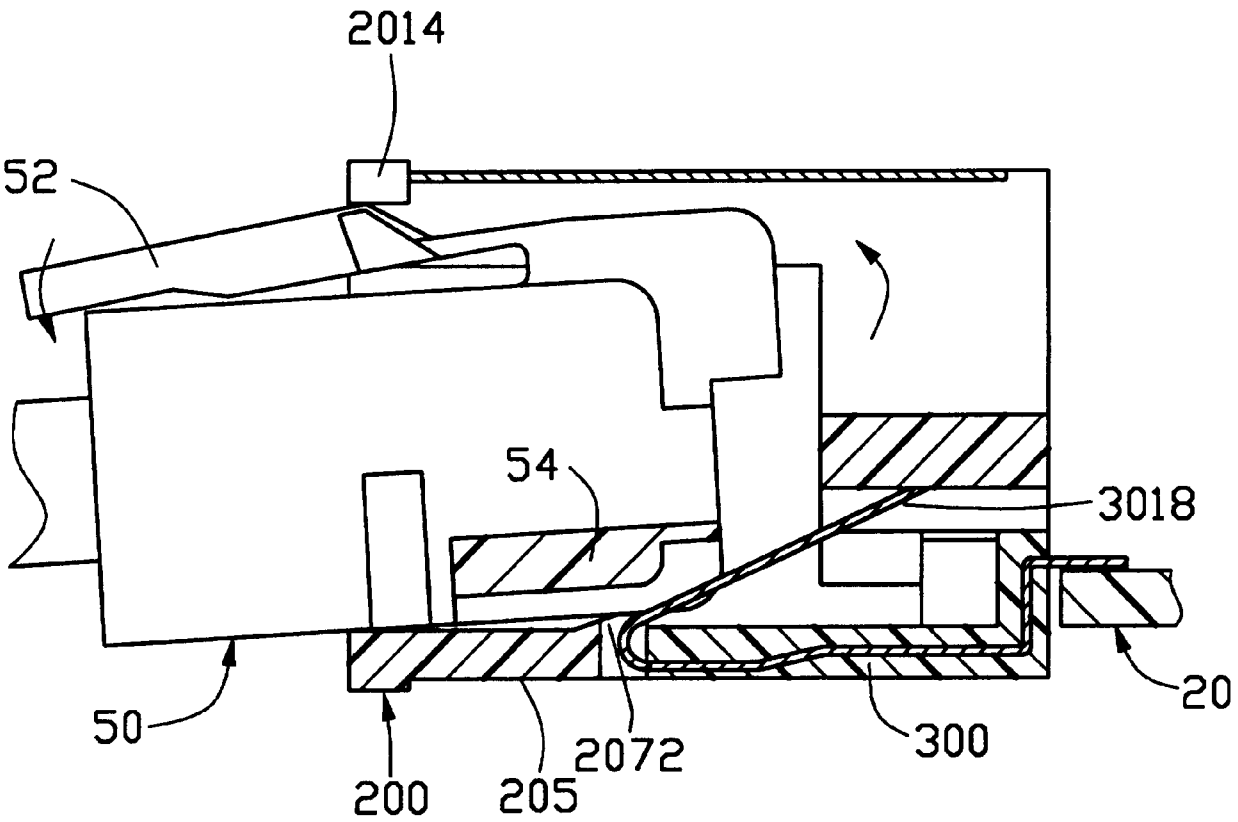

In the second step as shown in FIG. 10, the mating plug connector 50 is upward biased and angularly moved far away from a horizontal wall 205 of the housing 200 by means of shifting of the slant 2072 formed on the horizontal wall 205. During the second step, although the mating plug connector 50 starts depressingly engaging with the engaging sections 3018 of the contacts, the upward bias of the mating plug connector 50 can efficiently reduce the insertion force of directly impacting the engaging sections 3018 of the contacts 300, horizontally. Also, as mentioned in FIG. 8, the first angle A1 of the slant 2072 is substantially identical with or more than the second angle A2 of the engaging sections 3018 of the contacts 300, and the jointing point of the engaging section 3018 with the bight section 301 of each of the contacts 300 either overlaps with the innermost surface of the horizontal wall 205 of the housing 200, or located between the innermost and outermost surfaces of the horizontal wall 205 of the housing 200. Thus, the insertion force of the mating connector 50 can be lowered more. The final of the second step is that the mating plug connector 50 is moved to reach the second position where the connector 50 abuts against the shell 100 as shown in FIG. 11.

It is noted that the holder sections 2014 of the housing 200 can resiliently compress the latch 52 of the mating plug connector 50 toward the horizontal wall 205 thereby facilitating the upward bias of the mating plug connector 50 as a rotation upon the slant 2072 of the housing 200.

Figure 7:
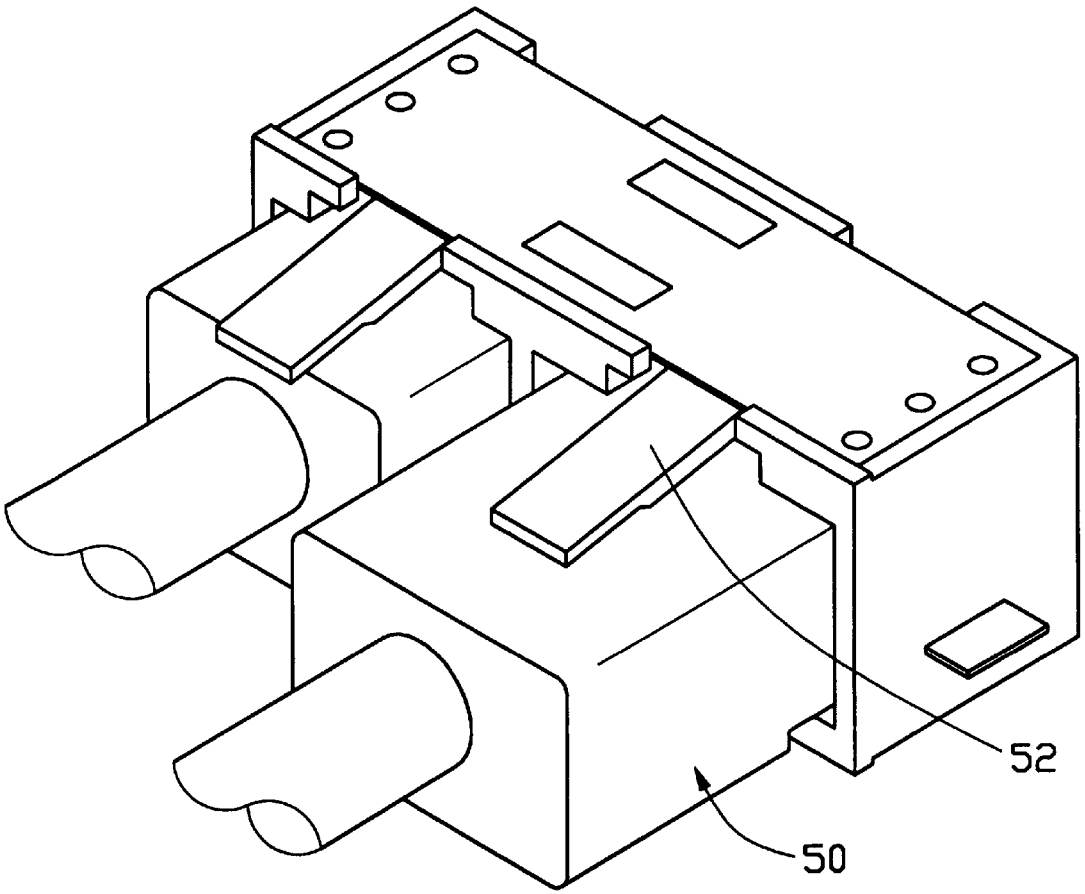
FIG. 7 is a perspective view of the electrical connector assembly of FIG. 1 mated with a plurality of mating connectors.
Figure 11:
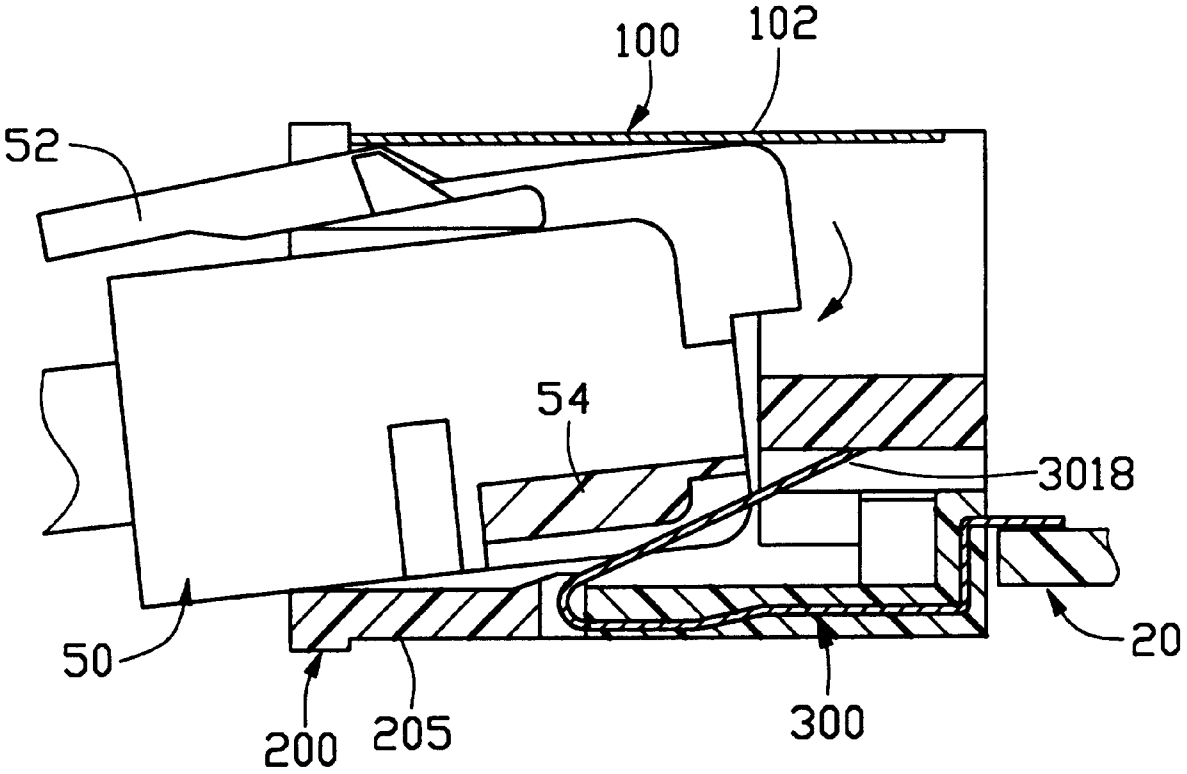

In the third step as shown in FIG. 11, the mating plug connector 50 is reversedly biased and deeply deflect the engaging sections 3018 of the contacts 300 toward the horizontal wall 205 by means of the shell 100 for efficiently electrical engagement of the contacts 54 with the engaging sections 3018. As long as the mating connector 50 reach the third position to exactly engage with the contacts 3018, the latch 52 of the mating connector 50 passes across the holder sections 2014 of the housing 200 and is incompletely released within the slot 209 but efficiently oppositely locks with the holder section 2014 of the housing 200 as shown in FIGS. 7 & 12, wherein the latch 52 is somewhat depressed to provide a reaction force for urging the contact 54 to reliably engage the corresponding engaging section 3018.of the corresponding contact 300.

While the present invention has been described with reference to specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I Claim:

1. A low profile electrical connector for electrical connection of a mating electrical connector with a circuit board having plenty of conductive traces formed thereof, comprising:

an insulative housing having an integral thin horizontal wall located parallel to the circuit board, a plurality of vertical walls positioned normal to the horizontal wall, and a receiving space defined among the vertical walls and the horizontal wall for reception of the mating connector therein; and a plurality of contacts each having a base section fixedly received inside the thin vertical wall of the housing, an engaging section integrally connected with one of opposed ends of the base section and extending out of the horizontal wall at a first angle with regard to the horizontal wall for electrical engagement with the mating connector inserted into the receiving space of the housing, and a tail section extending out of the housing from the other end of the base section to reach the corresponding conductive trance of the circuit board wherein a slant integrally protrudes from an innermost surface of the horizontal wall of the housing at a position adjacent to an outlet where the engaging section of each of the contacts extends through the horizontal wall, at a second angle with regard to the horizontal wall thereby biasing the mating connector far away from the horizontal wall to reduce the insertion force acted on the engaging sections of the contacts as soon as the mating connector is inserted into the receiving space of the housing and engages the slant;

wherein a bight section interconnects the engaging section and the base section of each of the contacts;

wherein the bight sections of the contacts are received in the slant.

* * * * *